US008098019B2

(12) United States Patent
Hung

(10) Patent No.: US 8,098,019 B2
(45) Date of Patent: Jan. 17, 2012

(54) DRIVING CIRCUIT OF MULTI-LAMPS

(75) Inventor: Chien-Pang Hung, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 377 days.

(21) Appl. No.: 12/469,668

(22) Filed: May 20, 2009

(65) Prior Publication Data

US 2009/0309508 A1 Dec. 17, 2009

(30) Foreign Application Priority Data

Jun. 11, 2008 (TW) ..... 97121766 A

(51) Int. Cl.
*H05B 41/36* (2006.01)

(52) U.S. Cl. ..... 315/254; 315/276; 315/277; 315/308; 315/312

(58) Field of Classification Search ..... 315/209 R, 315/210, 212, 220, 250, 254–255, 274–277, 315/279, 307–308, 312; 345/102
See application file for complete search history.

(56) References Cited

U.S. PATENT DOCUMENTS 6,703,796 B2 * 3/2004 Che-Chen et al. ..... 315/291
7,081,717 B2 * 7/2006 Suzuki ..... 315/213
7,230,390 B2 * 6/2007 Wu ..... 315/213
2005/0017647 A1 1/2005 Huang
2006/0043909 A1 * 3/2006 Hwang et al. ..... 315/276
2007/0205758 A1 * 9/2007 Corbin et al. ..... 324/158.1
2007/0262727 A1 * 11/2007 Suzuki et al. ..... 315/219
2008/0151450 A1 * 6/2008 Hsu et al. ..... 361/86
2008/0211423 A1 * 9/2008 Shinmen et al. ..... 315/259

* cited by examiner

*Primary Examiner* — Douglas W Owens
*Assistant Examiner* — Thai Pham
(74) *Attorney, Agent, or Firm* — Jianq Chyun IP Office

(57) ABSTRACT

A driving circuit of multi-lamps including a power supply module, a transformer module, a first detection module, and a control module is provided. Whether the power supply module is turned off is controlled by a control signal. The transformer module respectively provides a driving signal and an inverted driving signal to a first terminal and a second terminal of each lamp according to the AC signal. The first detection module detects a first indication signal combined by signals of the first terminal of one lamp and the second terminal of another lamp. The control module generates the control signal according to the first indication signal. Therefore, whether the lamps have a problem of a short circuit or an open circuit, or are in abnormal states can be known from the variations of the first indication signal, and a protection function for the driving circuit can be activated.

10 Claims, 8 Drawing Sheets

DRIVING CIRCUIT OF MULTI-LAMPS

CROSS-REFERENCE TO RELATED APPLICATION

This application claims the priority benefit of Taiwan application serial no. 97121766, filed on Jun. 11, 2008. The entirety of the above-mentioned patent application is hereby incorporated by reference herein and made a part of specification.

BACKGROUND OF THE INVENTION

1. Field of the Invention

The present invention relates to a driving circuit of multi-lamps and more particularly, to a driving circuit that can detect whether the multi-lamps are in abnormal states and thereby activate a protection mechanism.

2. Description of Related Art

The liquid crystal display (LCD) has become a mainstream in the market due to its advantages of low power consumption, no radiation, and low electromagnetic interference. Generally, the LCD includes an LCD panel and a backlight module. Since the LCD panel has no capacity of emitting light by itself, the backlight module is disposed for providing a light source required by the LCD panel. The backlight module is generally implemented by a cold cathode fluorescent lamp (CCFL) to serve as a light source.

As design of the LCD panel has a development trend toward vast size, application of multi-lamps is inevitable. However, utilization of the multi-lamps can cause a number of problems, for example, brightness inconsistency caused by uneven distribution of a lamp current, management of abnormal states such as a short circuit or an open circuit occurring in the lamps, and design of a protection circuit aimed at protecting human safety.

FIG. 1 is a schematic diagram illustrating a conventional protection circuit of multi-lamps. Referring to FIG. 1, current detection devices 120*a* and 120*b* respectively detect currents of lamps 110*a* and 110*b* to determine whether the lamps 110*a* and 110*b* are in the abnormal states. When the lamps 110*a* and 110*b* are under normal operation, signals at nodes Xa and Xb are at a high level. If one of the lamps (e.g. the lamp 110*a*) malfunctions or has a problem of short circuit or open circuit, the level of the signal at the node Xa then decreases to near zero. In the meanwhile, a diode Da within the current detection device 120*a* is conducted to activate a protection circuit 130 so as to prevent transformers 140*a* and 140*b* from outputting voltages to the lamps 110*a* and 110*b*.

Certainly, a plurality of voltage detection devices can be applied to respectively detect the voltage levels of the lamps in the protection circuit of the multi-lamps so as to detect an operation state of each lamp and accordingly determine whether or not to activate the protection circuit 130. However, the conventional protection circuit of the multi-lamps adopting a method of independently detecting the operation state of each lamp. Namely, the quantity of the current or voltage detection devices increases with the quantity of lamps, which indeed leads to additional hardware cost.

SUMMARY OF THE INVENTION

The present invention provides a driving circuit of multi-lamps, in which signals of two electrically connected lamps are combined to detect an operation state of a lamp since the signals of two terminals of the lamp have different phase features. When at least one of the connected lamps is in abnormal state, a power supply is stopped and a protection function is activated.

A driving circuit of multi-lamps, which includes a power supply module, a transformer module, a first detection module, and a control module, is provided in the present invention. The power supply module provides an alternating current (AC) signal to the transformer module, wherein the power supply module is controlled by a control signal to determine whether the power supply module is to be turned off. The transformer module is electrically connected to the power supply module, and respectively provides a driving signal and an inverted driving signal to a first terminal and a second terminal of each lamp according to the AC signal. The lamps at least include a first lamp and a second lamp. The first detection module detects a first indication signal combined by signals of the first terminal of the first lamp and the second terminal of the second lamp, and transmits the first indication signal to the control module. The control module generates the control signal by comparing the first indication signal with a reference signal.

In an embodiment of the present invention, the driving circuit further includes a second detection module to detect a second indication signal combined by signals of the second terminal of the first lamp and the first terminal of the second lamp. The control module generates the control signal by comparing one of the first and the second indication signals with the reference signal.

A driving circuit of multi-lamps, which includes a power supply module, a transformer module, a first detection module and a control module, is provided in the present invention, wherein the lamps at least include a first lamp and a second lamp. The power supply module provides an AC signal to the transformer module, wherein the power supply module is controlled by a control signal to determine whether the power supply module is to be turned doff. The transformer module is electrically connected to the power supply module, and respectively provides a driving signal and an inverted driving signal to a first terminal of the first lamp and a first terminal of the second lamp according to the AC signal. The first detection module detects a first indication signal combined by signals of a second terminal of the first lamp and a second terminal of the second lamp, and transmits the first indication signal to the control module. The control module generates the control signal by comparing the first indication signal with a reference signal.

The driving circuit of the present invention respectively provides the driving signal and the inverted driving signal to the first terminal and the second terminal of each lamp to drive the lamps. The operation state of each lamp can be detected by referring to a signal combined by signals of a first terminal of one lamp and a second terminal of the other lamp. Moreover, another driving circuit of the present invention respectively provides the driving signal and the inverted driving signal to the first terminals of the two lamps to drive the lamps. The operation state of each lamp can be detected by referring to a signal combined by signals of the second terminals of the two lamps or by referring to a signal combined by signals of the first terminals of the two lamps. Therefore, when the lamps are detected to be in abnormal states, the power supply module stops providing power to the lamps to activate the protection function.

In order to make the aforementioned and other objects, features and advantages of the present invention comprehensible, a preferred embodiment accompanied with figures is described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
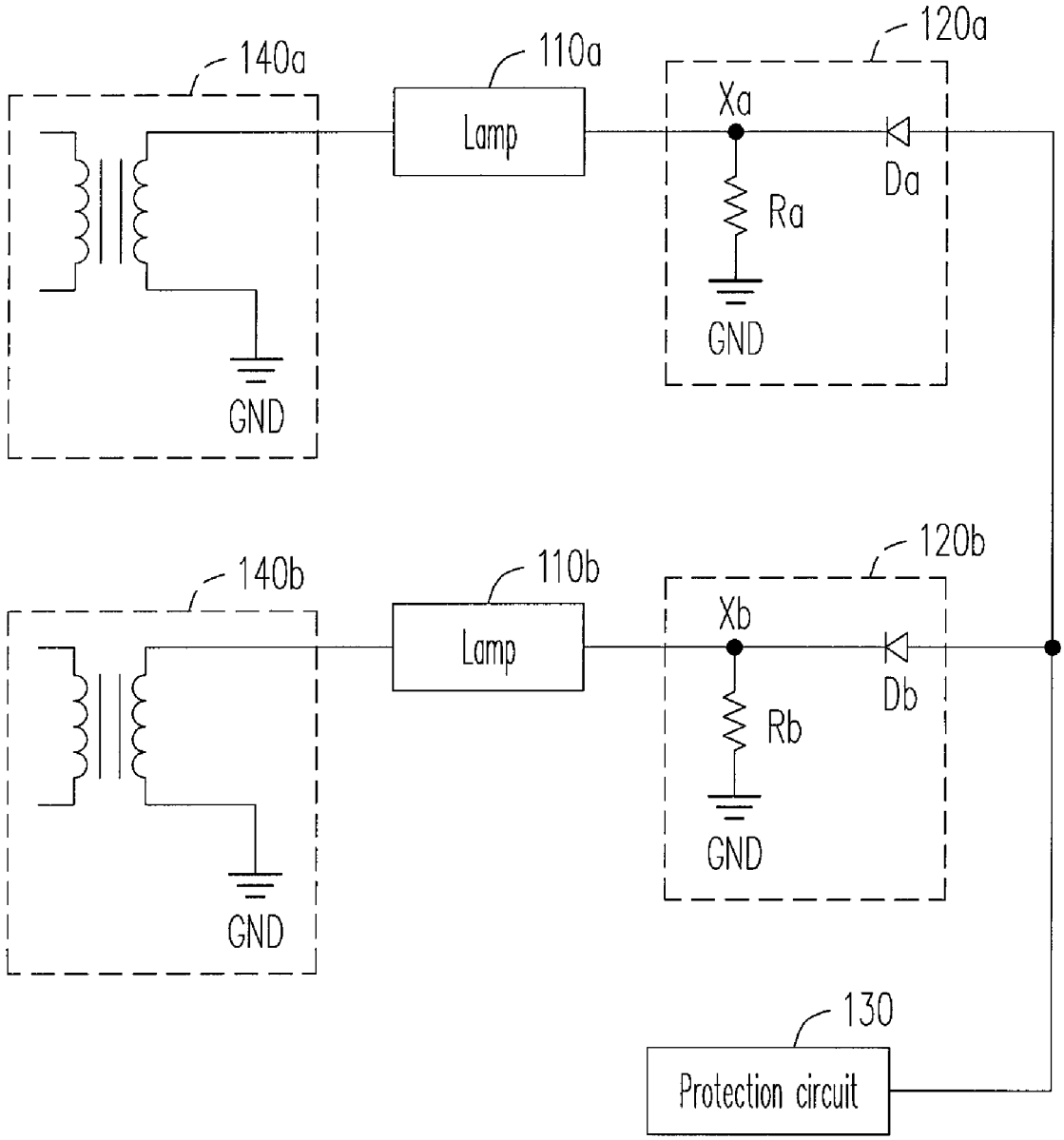
FIG. 1 is a schematic diagram illustrating a conventional protection circuit of multi-lamps.
Figure 2A:
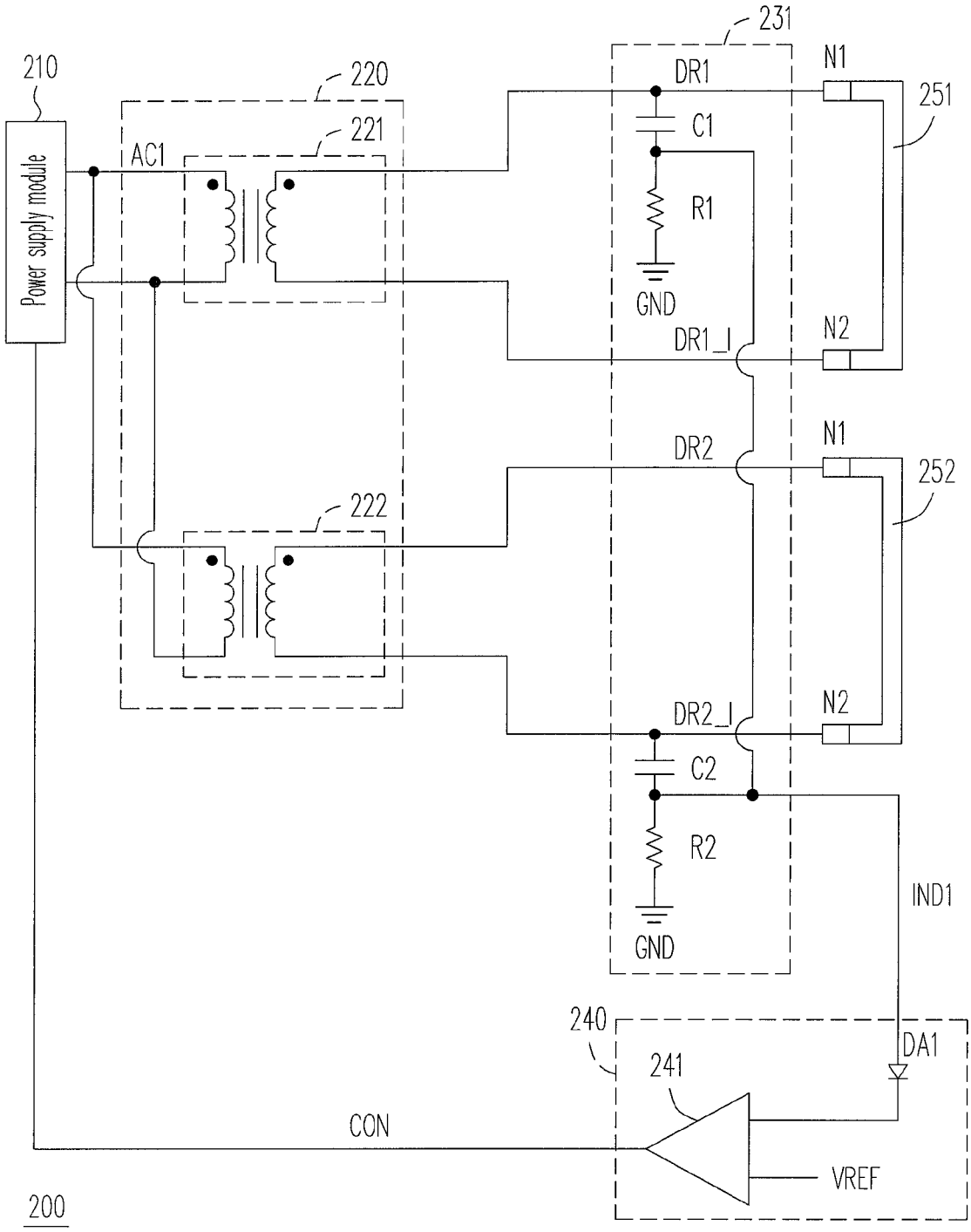
FIG. 2A is a schematic diagram illustrating a driving circuit of multi-lamps according to an embodiment of the present invention.

FIG. 2A is a schematic diagram illustrating a driving circuit of multi-lamps according to an embodiment of the present invention. Referring to FIG. 2A, the driving circuit 200 includes a power supply module 210, a transformer module 220, a detection module 231 and a control module 240. The power supply module 210 is controlled by a control signal CON to determine whether or not to be turned off, and the power supply module 210 provides an AC signal AC1 to the transformer module 220. The power supply module 210 is, for example, a direct current DC/AC converter, which can be a full-bridge converter, a half-bridge converter, a push-pull converter or a self-oscillating converter. In the present embodiment, only two lamps 251 and 252 are illustrated, and the lamps 251 and 252 are, for example, U-type CCFLs.

The transformer module 220 respectively provides a driving signal DR1 and an inverted driving signal DR1_I to a first terminal N1 and a second terminal N2 of the lamp 251, and respectively provides a driving signal DR2 and an inverted driving signal DR2_I to the first terminal N1 and the second terminal N2 of the lamp 252 according to the AC signal AC1, so as to drive the lamps 251 and 252. The detection module 231 detects an indication signal IND1 combined by signals of the first terminal N1 of the lamp 251 and the second terminal N2 of the lamp 252, and transmits the indication signal IND1 to the control module 240. The control module 240 generates the control signal CON by comparing the indication signal IND1 with a reference signal VREF, and whether or not the power supply module 210 is turned off is determined according to the received control signal CON.

In the present embodiment, the transformer module 220 includes transformers 221 and 222. A primary winding of the transformer 221 is electrically connected to the power supply module 210, and a positive terminal and an inverted terminal of a secondary winding of the transformer 221 are electrically connected respectively to the first terminal N1 and the second terminal N2 of the lamp 251. The secondary winding of the transformer 221 respectively provides the driving signal DR1 and the inverted driving signal DR1_I to the first terminal N1 and the second terminal N2 of the lamp 251 according to the AC signal AC1 at the primary winding of the transformer 221. Moreover, a primary winding of the transformer 222 is electrically connected to the power supply module 210, and the positive terminal and the inverted terminal of a secondary winding of the transformer 222 are electrically connected respectively to the first terminal N1 and the second terminal N2 of the lamp 252. The secondary winding of the transformer 222 respectively provides the driving signal DR2 an the inverted driving signal DR2_I to the first terminal N1 and the second terminal N2 of the lamp 252 according to the AC signal AC1 at the primary winding of the transformer 222.

Figure 2B:
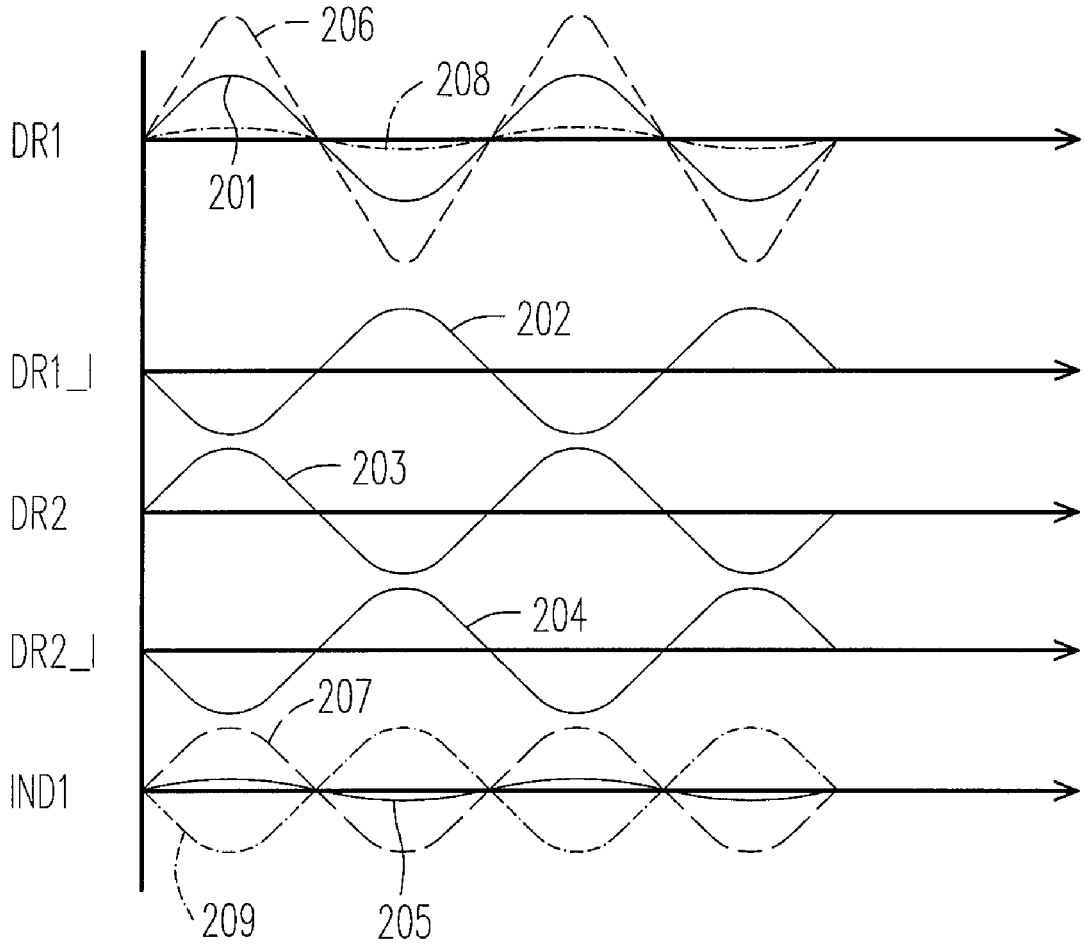
FIG. 2B is a diagram illustrating signal variations of a driving circuit of multi-lamps according to an embodiment of the present invention.

FIG. 2B is a diagram illustrating signal variations of the driving circuit of multi-lamps in FIG. 2A according to an embodiment of the present invention. Referring to FIG. 2A and FIG. 2B, when the lamp 251 is under normal operation, as shown in curves 201 and 202, amplitudes of the signals at the two terminals of the lamp 251 are similar, but phases of the signals at the two terminals of the lamp 251 are inverted. Similarly, when the lamp 252 is under normal operation, as shown in curves 203 and 204, the phases of the signals at the two terminals of the lamp 252 are also inverted. If one of the lamps or the two lamps is/are in an abnormal state, the signals at the two terminals of the lamp are then significantly changed and thus have a difference in the amplitude. Therefore, the detection module 231 detects a sum of a voltage signal of the first terminal N1 of the lamp 251 and a voltage signal of the second terminal N2 of the lamp 252 to serve as the indication signal IND1 for determining an operation state of the lamp. The control module 240 compares the indication signal IND1 with the reference signal VREF to generate the control signal CON.

The detection module 231 includes detection elements C1, C2, R1, and R2. In the present embodiment, the detection elements C1 and C2 are, for example, capacitors and the detection elements R1 and R2 are, for example, resistors. A first terminal of the capacitor C1 is electrically connected to the first terminal N1 of the lamp 251, and a second terminal of the capacitor C1 outputs the indication signal IND1. A first terminal and a second terminal of the resistor R1 are electrically connected respectively to the second terminal of the capacitor C1 and a ground voltage GND. A first terminal and a second terminal of the capacitor C2 are electrically connected respectively to the second terminal N2 of the lamp 252 and the second terminal of the capacitor C1. A first terminal and a second terminal of the resistor R2 are electrically connected respectively to the second terminal of the capacitor C2 and the ground voltage GND. The control module 240 includes a receiving element DA1 and a comparator 241. The receiving element DA1 is, for example, a diode. An anode of the diode DA1 receives the indication signal IND1. A first input terminal of the comparator 241 is electrically connected to a cathode of the diode DA1, a second input terminal of the comparator 241 receives the reference signal VREF, and an output terminal of the comparator 241 generates the control signal CON. The detection elements C1, C2, R1, and R2 can be capacitors, resistors, inductors, hall elements, or other elements having voltage drops when currents pass by.

Since the voltage signal of the first terminal N1 of the lamp 251 is inverted to the voltage signal of the second terminal N2 of the lamp 252 (shown as curves 201 and 203), the indication signal IND1 detected by the detection module 231 is close to zero (shown as a curve 205) when the lamps 251 and 252 are under normal operation. At this time, the diode DA1 in the control module 240 is not conducted, and outputs a near-zero voltage signal to the first input terminal of the comparator 241. The comparator 241 compares the near-zero voltage signal with the reference signal VREF, and outputs the control signal CON having a first logic level, e.g. a logic low level, to the power supply module 210. The power supply module 210 determines that the lamps 251 and 252 are under normal operation according to the control signal CON having the logic low level, and the power supply module 210 continuously provides the power supply.

If one of the lamps (for example, the lamp 251) has an open circuit, the voltage signal of the first terminal N1 of the lamp 251 increases (shown as a curve 206). At this time, the lamp 252 is still under normal operation, and the voltage signal of the second terminal N2 of the lamp 252 is not changed (shown as the curve 204). Therefore, a sum of the voltage signal of the first terminal N1 of the lamp 251 and the voltage signal of the second terminal N2 of the lamp 252, i.e. the indication signal IND1 detected by the detection module 231, is not close to zero (shown as a curve 207), so that the diode DA1 is conducted to transmit the indication signal IND1 to the first input terminal of the comparator 241. The comparator 241 compares the indication signal IND1 with the reference signal VREF, and outputs the control signal CON having a second logic level, e.g. a logic high level, to the power supply module 210. The power supply module 210 determines that the lamps 251 and 252 are in abnormal states according to the control signal CON having the logic high level, and the power supply module 210 accordingly stops providing the power supply to activate the protection function.

If a short circuit occurs in one of the lamps (for example, the lamp 251), the voltage signal of the first terminal N1 of the lamp 251 is zero (shown as a curve 208). At this time, the lamp 252 is still under normal operation, and the voltage signal of the second terminal N2 of the lamp 252 is not changed (shown as the curve 204). Therefore, the indication signal IND1 detected by the detection module 231 is not close to zero (shown as a curve 209) so that the diode DA1 is conducted to transmit the indication signal IND1 to the first input terminal of the comparator 241. The comparator 241 compares the indication signal IND1 with the reference signal VREF, and outputs the control signal CON having the second logic level, e.g. the logic high level, to the power supply module 210. The power supply module 210 determines that the lamps 251 and 252 are in abnormal states according to the control signal CON having the logic high level, and the power supply module 210 accordingly stops providing the power supply to activate the protection function.

Figure 3:
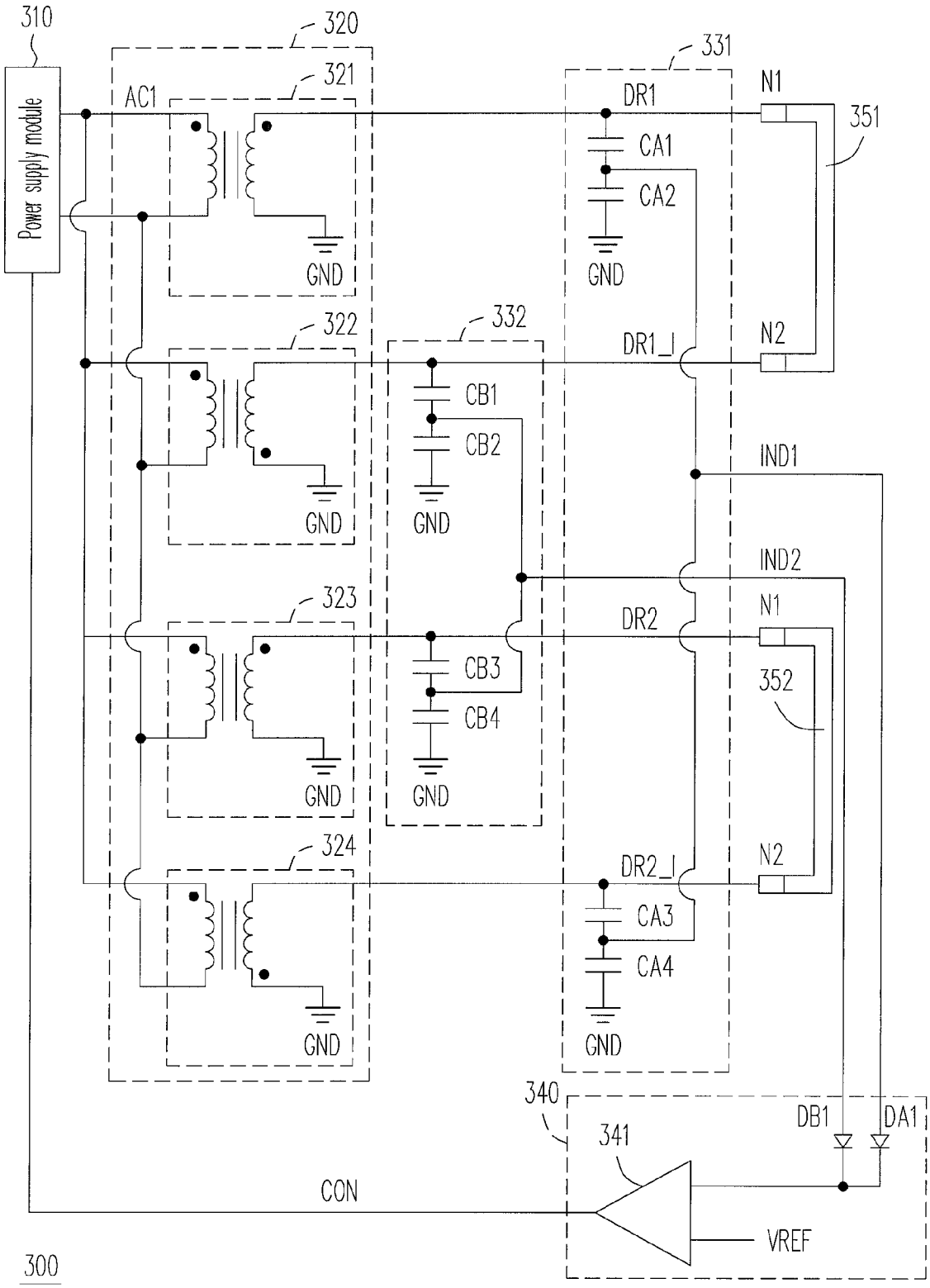
FIG. 3 is a schematic diagram illustrating a driving circuit of multi-lamps according to an embodiment of the present invention.

FIG. 3 is a schematic diagram illustrating a driving circuit of multi-lamps according to an embodiment of the present invention. Referring to FIG. 3, the driving circuit 300 includes a power supply module 310, a transformer module 320, detection modules 331 and 332, and a control module 340. In FIG. 3, the transformer module 320 includes transformers 321-324. The transformers 321 and 322 respectively provide the driving signal DR1 and the inverted driving signal DR1_I to a first terminal N1 and a second terminal N2 of a lamp 351 according to the AC signal AC1, and the transformers 323 and 324 respectively provide the driving signal DR2 and the inverted driving signal DR2_I to the first terminal N1 and the second terminal N2 of the lamp 352 according to the AC signal AC1. The detection module 331 detects the indication signal IND1 combined by signals of the first terminal N1 of the lamp 351 and the second terminal N2 of the lamp 352, and the detection module 332 detects the indication signal IND2 combined by signals of the second terminal N2 of the lamp 351 and the first terminal N1 of the lamp 352. Therefore, the control module 340 generates the control signal CON by comparing one of the indication signals IND1 and IND2 with the reference signal VREF, and whether or not the power supply module 310 is turned off is determined according to the logic level of the control signal CON.

A primary winding of the transformer 321 is electrically connected to the power supply module 310, and a positive terminal and an inverted terminal of a secondary winding of the transformer 321 are electrically connected respectively to the first terminal N1 of the lamp 351 and the ground voltage GND. A primary winding of the transformer 322 is electrically connected to the power supply module 310, and a positive terminal and an inverted terminal of a secondary winding of the transformer 322 are electrically connected respectively to the ground voltage GND and the second terminal N2 of the lamp 351. A primary winding of the transformer 323 is electrically connected to the power supply module 310, and a positive terminal and an inverted terminal of a secondary winding of the transformer 323 are electrically connected respectively to the first terminal N1 of the lamp 352 and the ground voltage GND. A primary winding of the transformer 324 is electrically connected to the power supply module 310, and a positive terminal and an inverted terminal of a secondary winding of the transformer 324 are electrically connected respectively to the ground voltage GND and the second terminal N2 of the lamp 352.

The detection modules 331 and 332 can be implemented according to the same approach. Taking the detection module 331 as an example, the detection module 331 includes detection elements CA1-CA4. The detection elements CA1-CA4 are, for example, capacitors. A first terminal of the capacitor CA1 is electrically connected to the first terminal N1 of the lamp 351, and a second terminal thereof outputs the indication signal IND1. A first terminal and a second terminal of the capacitor CA2 are electrically connected respectively to the second terminal of the capacitor CA1 and the ground voltage GND. A first terminal and a second terminal of the capacitor CA3 are electrically connected respectively to the second terminal N2 of the lamp 352 and the second terminal of the capacitor CA1. A first terminal and a second terminal of the capacitor CA4 are electrically connected respectively to the second terminal of the capacitor CA3 and the ground voltage GND. The detection module 331 detects a sum of the voltage signal of the first terminal N1 of the lamp 351 and the voltage signal of the second terminal N2 of the lamp 352 to serve as the indication signal IND1. Similarly, the detection module 332 includes detection elements CB1-CB4, and the detection elements CB1-CB4 are, for example, capacitors. The detection module 332 detects a sum of the voltage signal of the second terminal N2 of the lamp 351 and the voltage signal of the first terminal N1 of the lamp 352 to serve as the indication signal IND2. The detection elements CA1-CA4 or the detection elements CB1-CB4 can be capacitors, resistors, inductors, hall elements, or other devices that have voltage drops when currents pass by. Certainly, in another embodiment of the present invention, the detection modules 331 and 332 can also be embodied by the detection module 231 of FIG. 2A.

The control module 340 includes receiving elements DA1 and DB1, and a comparator 341. The receiving elements DA1 and DB1 are, for example, diodes. An anode of the diode DA1 receives the indication signal IND1. An anode of the diode DB1 receives the indication signal IND2, and a cathode of the diode DB1 is electrically connected to a cathode of the diode DA1. A first input terminal of the comparator 341 is electrically connected to the cathode of the diode DA1 and the cathode of the diode DB1, a second input terminal of the comparator 341 receives the reference signal VREF, and an output terminal of the comparator 341 generates the control signal CON. The receiving elements DA1 and DB1 can be OR gates or diodes.

The operation of the driving circuit of FIG. 3 is similar to that of FIG. 2A and FIG. 2B and is described as follows. Since the voltage signal of the first terminal N1 of one of the lamps is inverted to the voltage signal of the second terminal N2 of the other lamp, the sum of the voltage signal of the first terminal N1 of the lamp 351 and the voltage signal of the second terminal N2 of the lamp 352 (i.e. the indication signal IND1) is close to zero when the lamps 351 and 352 are under normal operation. Moreover, the sum of the voltage signal of the second terminal N2 of the lamp 351 and the voltage signal of the first terminal N1 of the lamp 352 (i.e. the indication signal IND2) is close to zero when the lamps 351 and 352 are under normal operation. At this time, the diodes DA1 and DB1 in the control module 340 are not conducted, and the comparator 341 outputs the control signal CON having the first logic level, e.g. the logic low level. The power supply module 310 determines that the lamps 351 and 352 are under normal operation according to the control signal CON having the logic low level, and the power supply module 310 continuously provides the power supply to the lamps.

If one of the lamps (for example, the lamp 251) is in an abnormal state; that is, for example, an open circuit or a short circuit occurs in the lamp, one of the indication signals IND1 and IND2 significantly increases to conduct the corresponding diode. The comparator 341 compares one of the indication signals IND1 and IND2 with the reference signal VREF, and outputs the control signal CON having the second logic level, e.g. the logic high level. The power supply module 310 determines that the lamps 351 and 352 are in abnormal states according to the control signal CON having the logic high level, and the power supply module 310 accordingly stops providing the power supply to the lamp to activate the protection function. The logic high level and the logic low level in another embodiment of the present invention can be contrarily defined.

The voltage signal of the first terminal N1 of one of the lamps and the voltage signal of the second terminal N2 of the other lamp are combined as the indication signal for determining the operation states of the lamps according to the different phase features of the signals of the two terminals of the lamp. However, those skilled in the art should understand that a current signal of the first terminal N1 of one of the lamps and a current signal of the second terminal N2 of the other lamp can also be combined to serve as the indication signal. In the following content, another embodiment is provided for detail description.

Figure 4A:
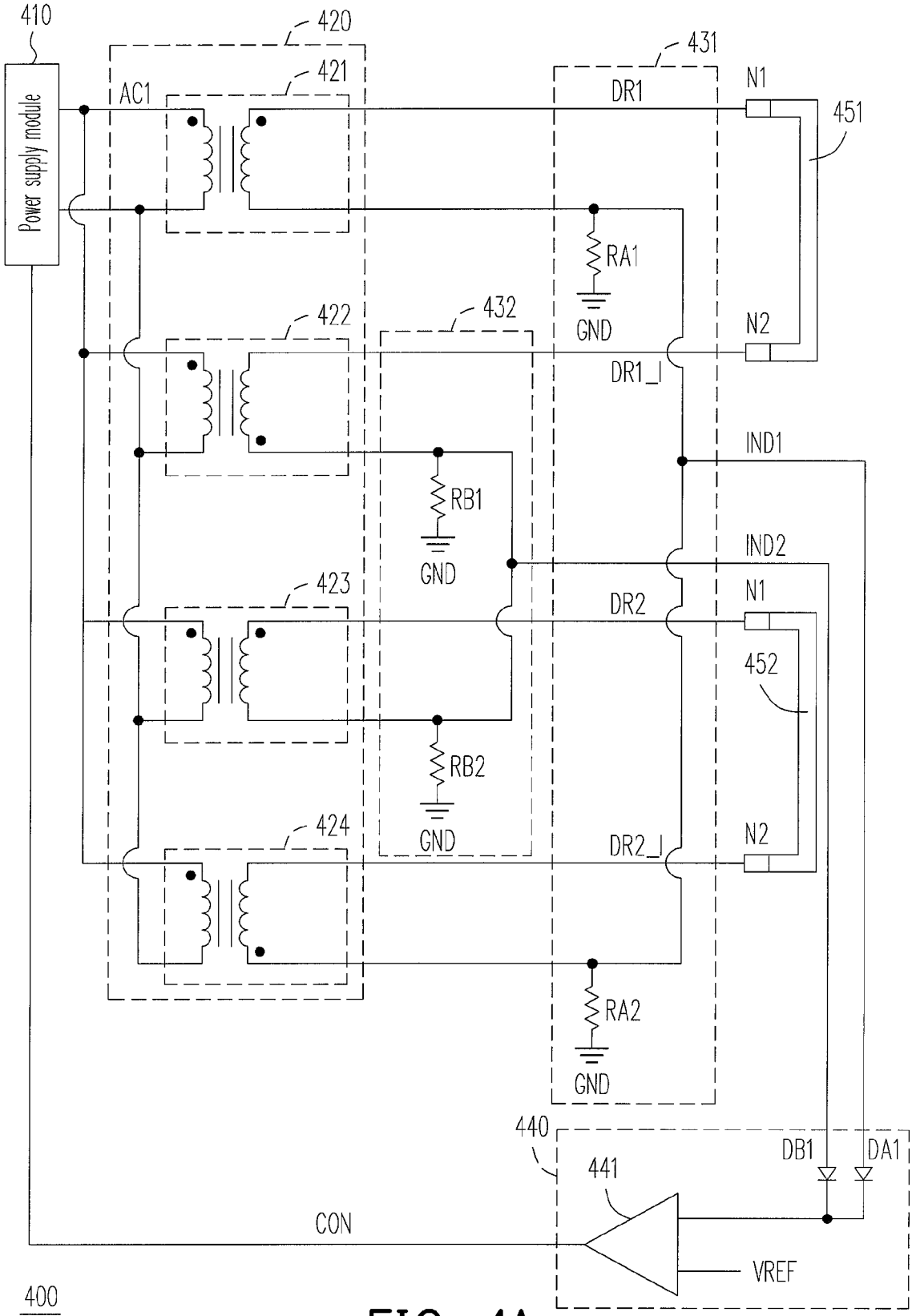
FIG. 4A is a schematic diagram illustrating a driving circuit of multi-lamps according to an embodiment of the present invention.

FIG. 4A is a schematic diagram illustrating a driving circuit of multi-lamps according to an embodiment of the present invention. Referring to FIG. 3 and FIG. 4A, a difference between FIG. 4A and FIG. 3 is that the detection modules 431 and 432 detect a sum of the current signal of the first terminal N1 of one of the lamps and the current signal of the second terminal N2 of the other lamp to serve as the indication signal for determining the operation states of the lamps. The detection modules 431 and 432 can be implemented by the same elements. Taking the detection module 431 as an example, the detection module 431 includes detection elements RA1 and RA2. The detection elements RA1 and RA2 are, for example, resistors. A first terminal of the resistor RA1 is electrically connected to an inverted terminal of a secondary winding of a transformer 421 to output the indication signal IND1, and a second terminal of the resistor RA1 is electrically connected to the ground voltage GND. A first terminal of the resistor RA2 is electrically connected to a positive terminal of a secondary winding of a transformer 424 and the first terminal of the resistor RA1, and a second terminal of the resistor RA2 is electrically connected to the ground voltage GND. The detection module 431 detects a sum of the current signal of the first terminal N1 of the lamp 451 and the current signal of the second terminal N2 of the lamp 452 to serve as the indication signal IND1. Similarly, the detection module 432 includes detection elements RB1 and RB2, and the detection elements RB1 and RB2 are, for example, resistors. The detection module 432 detects a sum of the current signal of the second terminal N2 of the lamp 451 and the current signal of the first terminal N1 of the lamp 452 to serve as the indication signal IND2. The detection elements can be resistors, inductors, capacitors, hall elements, or other devices having voltage drops when currents pass by.

Figure 4B:
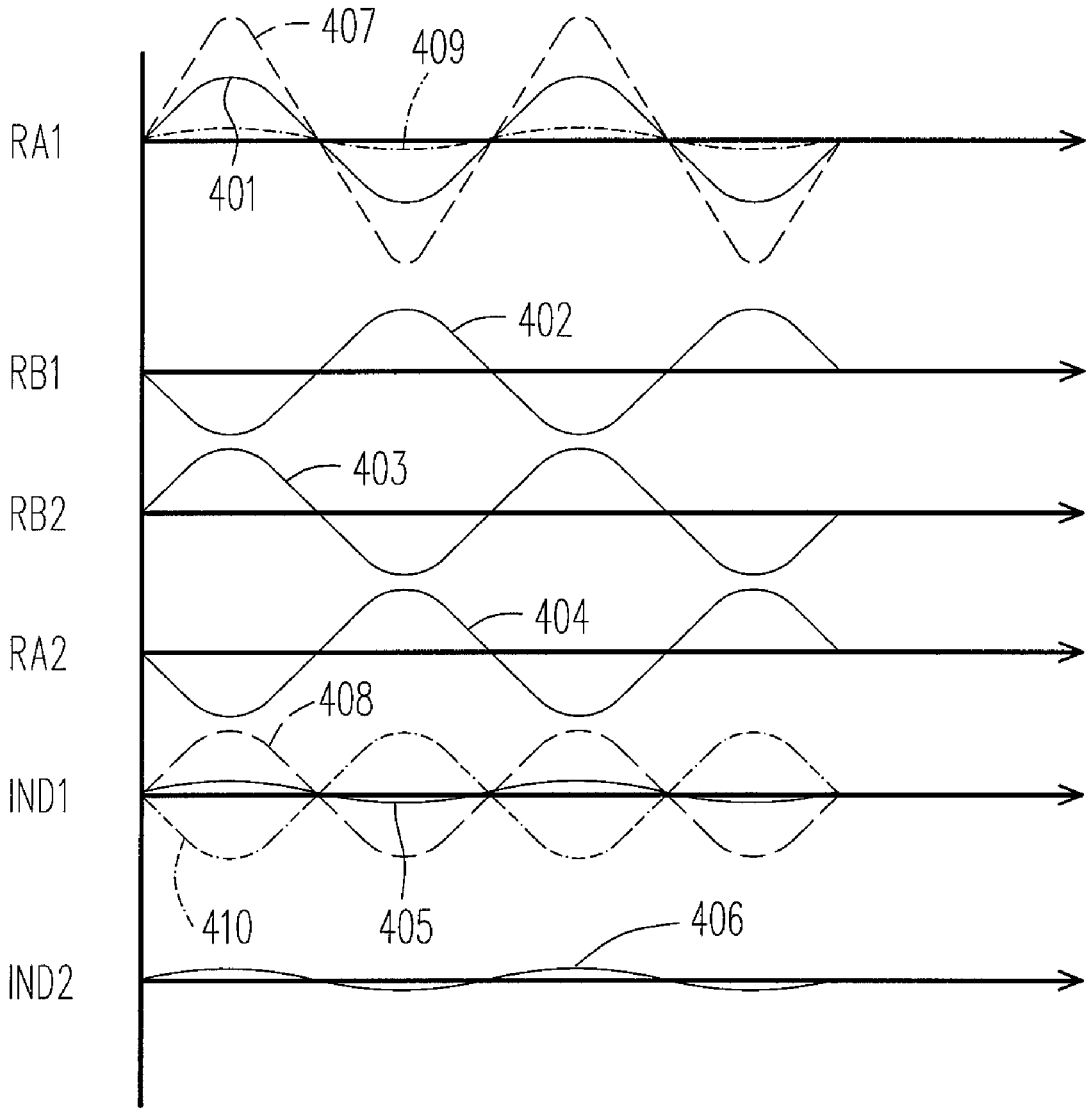
FIG. 4B is a diagram illustrating signal variations of a driving current of multi-lamps of FIG. 4A.

FIG. 4B is a diagram illustrating signal variations of the driving current of multi-lamps of FIG. 4A. Referring to FIG. 4A and FIG. 4B, when the lamps 451 and 452 are under normal operation, the current signals passing through the detection elements RA1, RA2, RB1, and RB2 are respectively shown as curves 401-404. Since the current signal of the first terminal N1 of one of the lamps is inverted to the current signal of the second terminal N2 of the other lamp, the combined indication signals IND1 and IND2 (respectively shown as curves 405 and 406) are close to zero when the lamps 451 and 452 are under normal operation. If an open circuit occurs in one of the lamps (for example, the lamp 451), the current signal (shown as a curve 407) passing through the detection element RA1 increases, and the combined indication signal IND1 (shown as a curve 408) accordingly increases. If a short circuit occurs in one of the lamps (for example, the lamp 451), the current signal (shown as a curve 409) passing through the detection element RA1 is close to zero, and the combined indication signal IND1 (shown as a curve 410) significantly increases since the current signal passing through the detection element RA2 does not changed (shown as the curve 403). Therefore, the control module 440 compares one of the indication signals IND1 and IND2 with the reference signal VREF to generate the control signal CON for determining the operation states of the lamps and determining whether the power supply module 410 is turned off. The operations of the transformer module 420 and the control module 440 are the same as that of the embodiment of FIG. 3, and therefore detailed description thereof is not repeated.

Though in the embodiments of FIG. 2A, FIG. 3, and FIG. 4A, the U-type CCFL is taken as an example, the spirit of the present invention that the operation states of the lamps are determined by combining the signals of the two lamps according to the different phase features of the signals of the two terminals of the lamp can also be applied to a general CCFL and is not limited thereto. To fully convey the spirit of the present invention to those skilled in the art, another embodiment is provided below for further description.

Figure 5:
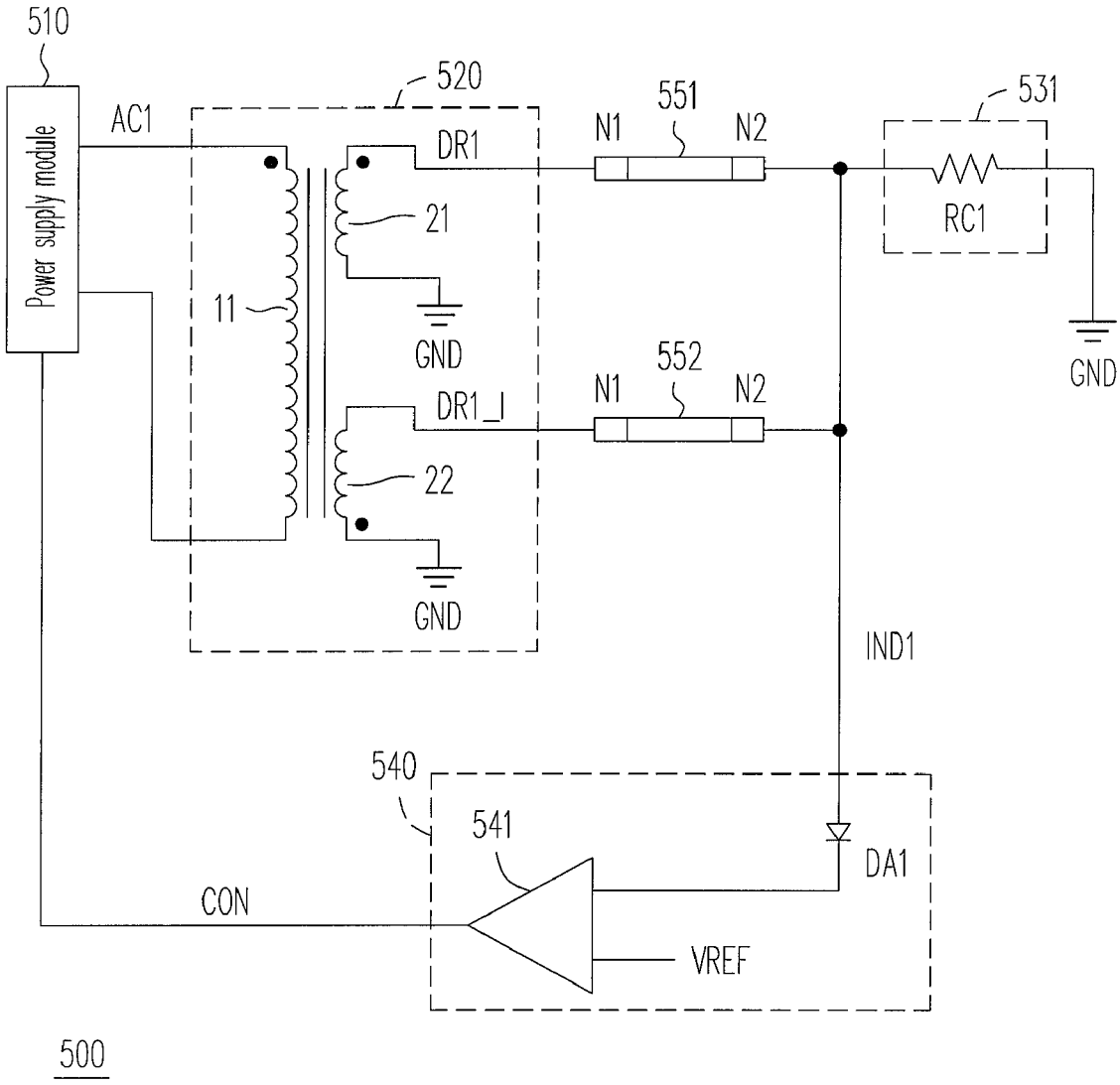
FIG. 5 is a schematic diagram illustrating a driving circuit of multi-lamps according to an embodiment of the present invention.

FIG. 5 is a schematic diagram illustrating a driving circuit of multi-lamps according to an embodiment of the present invention. Referring to FIG. 5, the driving circuit 500 includes a power supply module 510, a transformer module 520, a detection module 531 and a control module 540. The power supply module 510 provides the AC signal AC1 to the transformer module 520, and whether or not the power supply module 510 is turned off can be determined according to the logic level of the control signal CON. The transformer module 520 is electrically connected to the power supply module 510, and respectively provides the driving signal DR1 and the inverted driving signal DR1_I to the first terminal N1 of a lamp 551 and the first terminal N1 of a lamp 552 according to the AC signal AC1. The detection module 531 detects the indication signal IND1 combined by signals of the second terminal N2 of the lamp 551 and the second terminal N2 of the lamp 552. The control module 540 generates the control signal CON by comparing the indication signal IND1 with the reference signal VREF.

In the present embodiment, the transformer module 520 is implemented by one transformer, in which a primary winding 11 thereof is electrically connected to the power supply module 510, a positive terminal and an inverted terminal of a first secondary winding 21 thereof are electrically connected respectively to the first terminal N1 of the lamp 551 and the ground voltage GND, and a positive terminal and an inverted terminal of a second secondary winding 22 thereof are electrically connected respectively to the ground voltage GND and the first terminal N1 of the lamp 552. The detection module 531 includes a detection element RC1, wherein the detection element RC1 is, for example, a resistor. The detection module 531 detects a sum of the current signal of the second terminal N2 of the lamp 551 and the current signal of the second terminal N2 of the lamp 552 to serve as the indication signal IND1.

Since the transformer module 520 respectively provides the driving signal DR1 and the inverted driving signal DR1_I to the first terminal N1 of the lamp 551 and the first terminal N1 of the lamp 552, the current signal of the second terminal N2 of the lamp 551 is inverted to the current signal of the second terminal N2 of the lamp 552 when the lamps 551 and 552 are under normal operation so that the combined indication signal IND1 is close to zero. If one of the lamps is in an abnormal state, the combined indication signal then significantly changes. By such means, the control module 540 can detect the operation states of the lamps according to the variation of the indication signal IND1 and generate the control signal CON to determine whether the power supply module 510 is turned off.

Figure 6:
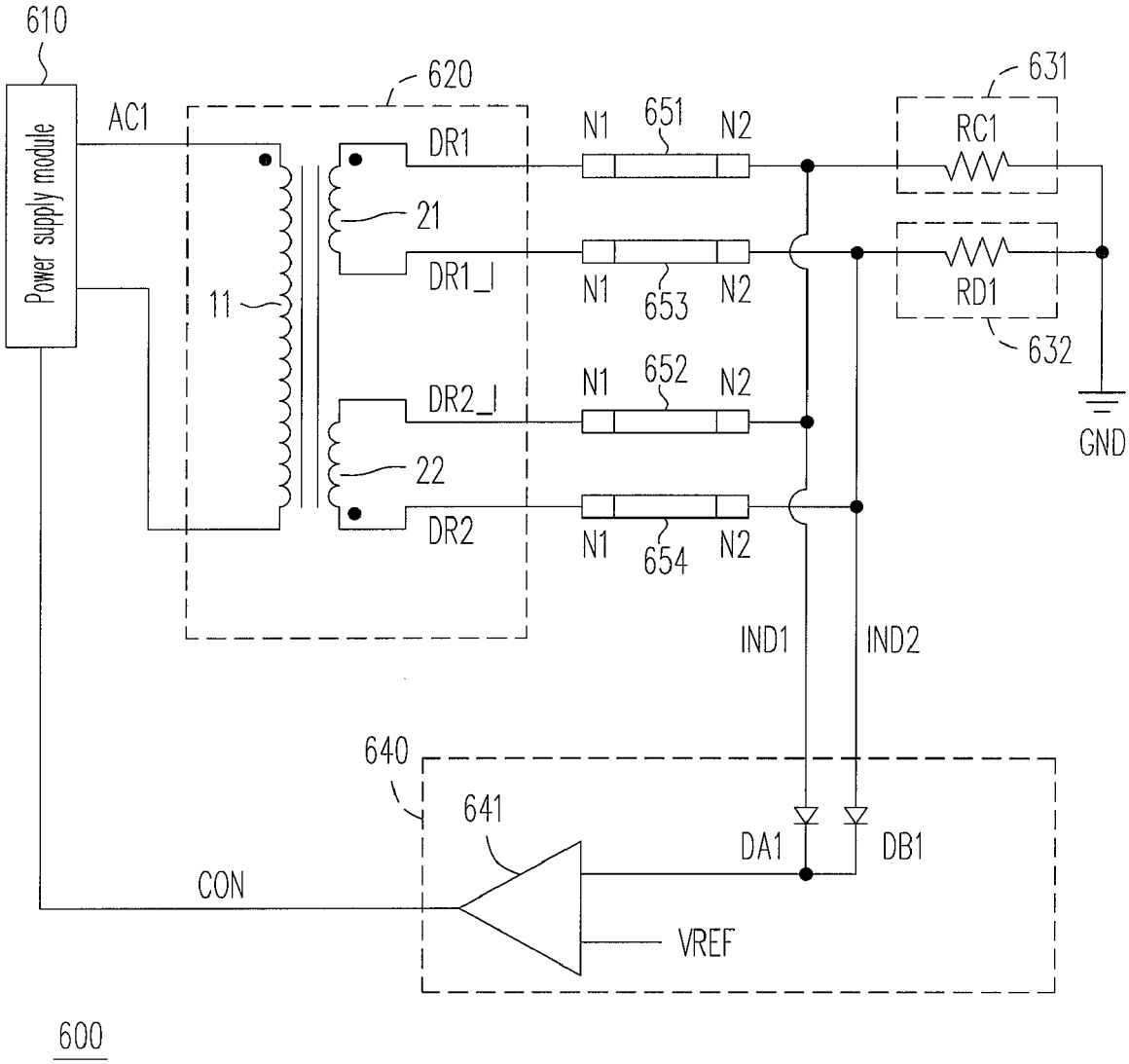
FIG. 6 is a schematic diagram illustrating a driving circuit of multi-lamps according to an embodiment of the present invention.

FIG. 6 is a schematic diagram illustrating a driving circuit of multi-lamps according to an embodiment of the present invention. Referring to FIG. 5 and FIG. 6, a difference between the embodiments in FIG. 5 and FIG. 6 is that the driving circuit 600 drives lamps 651-654 and further includes detection modules 631 and 632. The detection modules 631 and 632 respectively include at least one detection element, and the detection element is, for example, a resistor. The transformer module 620 is implemented by one transformer, in which a primary winding 11 thereof is electrically connected to the power supply module 610, a positive terminal and an inverted terminal of a first secondary winding 21 thereof are electrically connected respectively to the first terminal N1 of the lamp 651 and the first terminal N1 of the lamp 653, and a positive terminal and an inverted terminal of a second secondary winding 22 thereof are electrically connected respectively to the first terminal N1 of the lamp 654 and the first terminal N1 of the lamp 652. The transformer module 620 respectively provides the driving signal DR1 and the inverted driving signal DR1_I to the first terminal N1 of the lamp 651 and the first terminal N1 of the lamp 653, and respectively provides the driving signal DR2 and the inverted driving signal DR2_I to the first terminal N1 of the lamp 654 and the first terminal N1 of the lamp 652. The detection element can be a resistor, an inductor, a capacitor, a hall element, or other devices having voltage drops when currents pass by.

The detection module 631 detects a sum of the current signal of the second terminal N2 of the lamp 651 and the current signal of the second terminal N2 of the lamp 652 to serve as the indication signal IND1 according to the different phase features of the signals of the two terminals of the lamp. The detection module 632 detects a sum of the current signal of the second terminal N2 of the lamp 653 and the current signal of the second terminal N2 of the lamp 654 to serve as the indication signal IND2. Thereafter, the control module 640 compares one of the indication signals IND1 and IND2 with the reference signal VREF to determine the operation states of the lamps so as to generate the control signal CON, and accordingly whether the power supply module 610 is turned off is determined according to the logic level of the control signal CON.

It should be noted that in another embodiment of the present invention, the operation states of the lamps can be determined by detecting a signal combined by the signals of the first terminal N1 of the lamp 651 and the first terminal N1 of the lamp 652, and/or by detecting a signal combined by the signals of the first terminal N1 of the lamp 653 and the first terminal N1 of the lamp 654.

In summary, in the embodiments of FIG. 2A, FIG. 3, and FIG. 4, the transformer module respectively provides the driving signal and the inverted driving signal to the first terminal and the second terminal of each of the lamps. Since the signal of the first terminal of one of the lamps is inverted to the signal of the second terminal of the other lamp, the detection module combines the signals of the two terminals of different lamps to serve as the indication signal so as to determine the operation states of the lamps. Moreover, in FIG. 5 and FIG. 6, the transformer module respectively provides the driving signal and the inverted driving signal to the first terminals of the two lamps. The detection module combines the signal of the second terminal of one of the lamps and the signal of the second terminal of the other lamp according to the phase features of the signals of the two terminals of the lamps so as to serve as the indication signal for determining the operation states of the lamps. By such means, when the lamps are in abnormal states, the power supply module stops supplying the power so as to protect the driving circuit.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving circuit of multi-lamps, comprising:

a power supply module, providing an alternating current (AC) signal, wherein the power supply module is controlled by a control signal to determine whether or not the power supply module is turned off;

a transformer module, electrically connected to the power supply module for respectively providing a driving signal and an inverted driving signal to a first terminal and a second terminal of each lamp according to the AC signal, wherein the lamps at least comprise a first lamp and a second lamp;

a first detection module, detecting a first indication signal combined by signals of the first terminal of the first lamp and the second terminal of the second lamp; and a control module, comparing the first indication signal with a reference signal to generate the control signal;

a second detection module, detecting a second indication signal combined by signals of the second terminal of the first lamp and the first terminal of the second lamp, wherein the control module compares one of the first indication signal and the second indication signal with the reference signal to generate the control signal.

2. The driving circuit of multi-lamps as claimed in claim 1, wherein the control module comprises:

a receiving element, having a first terminal receiving the first indication signal; and a comparator, having a first input terminal electrically connected to a second terminal of the receiving element, a second input terminal receiving the reference signal, and an output terminal generating the control signal.

3. The driving circuit of multi-lamps as claimed in claim 1, wherein the first detection module detects a sum of a voltage signal of the first terminal of the first lamp and a voltage signal of the second terminal of the second lamp to serve as the first indication signal.

4. The driving circuit of multi-lamps as claimed in claim 3, wherein the first detection module comprises:

a first detection element, having a first terminal electrically connected to the first terminal of the first lamp, and a second terminal outputting the first indication signal;

a second detection element, having a first terminal electrically connected to the second terminal of the first detection element, and a second terminal electrically connected to a ground voltage;

a third detection element, having a first terminal electrically connected to the second terminal of the second lamp, and a second terminal electrically connected to the second terminal of the first detection element; and a fourth detection element, having a first terminal electrically connected to the second terminal of the third detection element, and a second terminal electrically connected to the ground voltage.

5. The driving circuit of multi-lamps as claimed in claim 1, wherein the second detection module detects a sum of a voltage signal of the second terminal of the first lamp and a voltage signal of the first terminal of the second lamp to serve as the second indication signal.

6. The driving circuit of multi-lamps as claimed in claim 5, wherein the second detection module comprises:

a first detection element, having a first terminal electrically connected to the second terminal of the first lamp, and a second terminal outputting the second indication signal;

a second detection element, having a first terminal electrically connected to the second terminal of the first detection element, and a second terminal electrically connected to a ground voltage;

a third detection element, having a first terminal electrically connected to the first terminal of the second lamp, and a second terminal electrically connected to the second terminal of the first detection element; and a fourth detection element, having a first terminal electrically connected to the second terminal of the third detection element, and a second terminal electrically connected to the ground voltage.

7. The driving circuit of multi-lamps as claimed in claim 1, wherein the transformer module comprises:

a first transformer, a primary winding thereof electrically connected to the power supply module, and a positive terminal and an inverted terminal of a secondary winding thereof electrically connected respectively to the first terminal and the second terminal of the first lamp; and a second transformer, a primary winding thereof electrically connected to the power supply module, and a positive terminal and an inverted terminal of a secondary winding thereof electrically connected respectively to the first terminal and the second terminal of the second lamp.

8. The driving circuit of multi-lamps as claimed in claim 1, wherein the transformer module comprises:

a first transformer, a primary winding thereof electrically connected to the power supply module, and a positive terminal and an inverted terminal of a secondary winding thereof electrically connected respectively to the first terminal of the first lamp and a ground voltage;

a second transformer, a primary winding thereof electrically connected to the power supply module, and a positive terminal and an inverted terminal of a secondary winding thereof electrically connected respectively to the ground voltage and the second terminal of the first lamp;

a third transformer, a primary winding thereof electrically connected to the power supply module, and a positive terminal and an inverted terminal of a secondary winding thereof electrically connected respectively to the first terminal of the second lamp and the ground voltage; and a fourth transformer, a primary winding thereof electrically connected to the power supply module, and a positive terminal and an inverted terminal of a secondary winding thereof electrically connected respectively to the ground voltage and the second terminal of the second lamp.

9. The driving circuit of multi-lamps as claimed in claim 1, wherein the lamps are U-type cold cathode fluorescent lamps (CCFL).

10. The driving circuit of multi-lamps as claimed in claim 1, wherein the power supply module is a DC/AC converter.

* * * * *